US006725897B2

(12) United States Patent
Palmer

(10) Patent No.: US 6,725,897 B2
(45) Date of Patent: Apr. 27, 2004

(54) VARIABLE FRICTION DEVICE FOR A CORDLESS BLIND

(75) Inventor: Roger C. Palmer, Greensboro, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 0 days.

(21) Appl. No.: 09/995,375

(22) Filed: Nov. 28, 2001

(65) Prior Publication Data

US 2002/0033241 A1 Mar. 21, 2002

Related U.S. Application Data

(60) Provisional application No. 60/226,847, filed on Aug. 22, 2000.

(51) Int. Cl.[7] ..... E06B 9/30

(52) U.S. Cl. ..... 160/168.1 R; 160/84.01; 160/121.1; 160/173 R

(58) Field of Search ..... 160/168.1 R, 84.01, 160/84.05, 121.1, 170 R, 171 R, 173 R

(56) References Cited

U.S. PATENT DOCUMENTS

| | | | | |
|---|---|---|---|---|
| 13,251 | A | 7/1855 | Bixler | |
| 322,732 | A | 7/1885 | Lang | |
| 842,401 | A | 1/1907 | Goodill | |
| 927,090 | A | 7/1909 | Anderson | |
| 948,239 | A | 2/1910 | McManus | |
| 1,636,601 | A | 7/1927 | Givens | |
| 1,721,501 | A | 7/1929 | McKee | |
| 1,731,124 | A | 10/1929 | Carper | |
| 1,789,655 | A | 1/1931 | Iwata | |
| 1,951,659 | A | 3/1934 | Kesner | 156/17 |
| 2,037,393 | A | 4/1936 | Roberts | 156/17 |
| 2,049,518 | A | 8/1936 | Schier | 156/16 |
| 2,110,983 | A | 3/1938 | Carver | 156/16 |

(List continued on next page.)

FOREIGN PATENT DOCUMENTS

| | | | | |
|---|---|---|---|---|
| DE | 40 03 218 A1 | | 8/1991 | |
| EP | 1 039 093 | | 9/2000 | |
| FR | 883 709 | | 7/1943 | |
| FR | 2 337 809 | | 8/1977 | |
| FR | 2811368 | * | 7/2000 | 160/168.1 R |
| GB | 13798 | | of 1893 | |
| GB | 2 262 324 A | | 6/1993 | |

OTHER PUBLICATIONS

"The Theory and Design of Long–Deflection Constant–Force Spring Elements", by F.A. Votta Jr., Lansdale, PA (12 pages).

(List continued on next page.)

*Primary Examiner*—Bruce A. Lev
(74) *Attorney, Agent, or Firm*—Marshall, Gerstein & Borun LLP

(57) ABSTRACT

A window covering including a head rail, a bottom rail, and a window covering material located between the head rail and the bottom rail. The bottom rail being connected to the head rail by two lift cords and configured to move in a first direction and a second direction. The blind also includes a variable friction device having a bearing surface configured to provide a first friction force that opposes movement of the two lift cords when the bottom rail is moved in the first direction, and a second friction force that opposes movement of the two lift cords wherein the bottom rail is moved in the second direction. The first friction force is different than the second friction force.

16 Claims, 12 Drawing Sheets

U.S. PATENT DOCUMENTS

| | | | | | |
|---|---|---|---|---|---|
| 2,175,549 | A | | 10/1939 | Nardulli et al. | 156/17 |
| 2,250,106 | A | | 7/1941 | Lorentzen | 156/17 |
| 2,260,101 | A | | 10/1941 | De Falco | 156/16 |
| 2,266,160 | A | | 12/1941 | Burns | 156/17 |
| 2,276,716 | A | | 3/1942 | Cardona | 156/17 |
| 2,324,536 | A | | 7/1943 | Pratt | 160/172 |
| 2,325,992 | A | | 8/1943 | Wirthman | 160/29 |
| 2,350,094 | A | | 5/1944 | Butts | 160/114 |
| 2,390,826 | A | | 12/1945 | Cohn | 160/170 |
| 2,410,549 | A | | 11/1946 | Olson | 160/34 |
| 2,420,301 | A | | 5/1947 | Cusumano | 160/34 |
| 2,509,033 | A | | 5/1950 | Carver | 160/84 |
| 2,520,629 | A | | 8/1950 | Esposito | 160/171 |
| 2,535,751 | A | | 12/1950 | Nardulli | 160/170 |
| 2,598,887 | A | | 6/1952 | Burns | 160/170 |
| 2,609,193 | A | | 9/1952 | Foster | 267/1 |
| 2,687,769 | A | | 8/1954 | Gershuny | 160/170 |
| 2,824,608 | A | | 2/1958 | Etten | 160/170 |
| 2,874,612 | A | | 2/1959 | Luboshez | 88/60 |
| 3,141,497 | A | | 7/1964 | Griesser | 160/170 |
| 3,194,343 | A | | 7/1965 | Sindlinger | 185/10 |
| 3,358,612 | A | | 12/1967 | Bleuer | 104/173 |
| 3,371,700 | A | | 3/1968 | Romano | 160/84 |
| 3,485,285 | A | | 12/1969 | Anderle | 160/168 |
| 3,487,875 | A | | 1/1970 | Shukat et al. | 160/84 |
| 3,756,585 | A | | 9/1973 | Mihalcheon | 267/156 |
| 3,817,309 | A | | 6/1974 | Takazawa | 160/84 |
| 4,157,108 | A | | 6/1979 | Donofrio | 160/263 |
| 4,205,816 | A | | 6/1980 | Yu | 248/266 |
| 4,223,714 | A | | 9/1980 | Weinreich et al. | 160/309 |
| 4,326,577 | A | | 4/1982 | Tse | 160/259 |
| 4,344,474 | A | | 8/1982 | Berman | 160/121 R |
| 4,398,585 | A | | 8/1983 | Marlow | 160/23 R |
| 4,487,243 | A | | 12/1984 | Debs | 160/168 R |
| 4,574,864 | A | | 3/1986 | Tse | 160/259 |
| 4,610,292 | A | | 9/1986 | Hausmann et al. | 160/120 |
| 4,623,012 | A | | 11/1986 | Rude et al. | 160/243 |
| 4,625,786 | A | | 12/1986 | Carter et al. | 160/84 R |
| 4,631,217 | A | | 12/1986 | Anderson | 428/118 |
| 4,647,488 | A | | 3/1987 | Schnebly et al. | 428/116 |
| 4,674,550 | A | | 6/1987 | Graves | 160/326 |
| 4,726,410 | A | | 2/1988 | Fresh | 160/84 R |
| 4,836,264 | A | | 6/1989 | Machin | 160/120 |
| 4,852,627 | A | | 8/1989 | Peterson et al. | 160/84.1 |
| 4,856,574 | A | | 8/1989 | Minami et al. | 160/168.1 |
| 4,862,941 | A | | 9/1989 | Colson | 160/84.1 |
| 4,877,075 | A | | 10/1989 | Markowitz | 160/84.1 |
| 4,880,045 | A | | 11/1989 | Stahler | 160/84.1 |
| 4,886,102 | A | | 12/1989 | Debs | 160/177 |
| 4,955,421 | A | | 9/1990 | Torti | 160/243 |
| 4,984,617 | A | | 1/1991 | Corey | 160/84.1 |
| 5,054,162 | A | | 10/1991 | Rogers | 16/198 |
| 5,067,541 | A | | 11/1991 | Coslett | 160/84.1 |
| 5,083,598 | A | | 1/1992 | Schon | 160/84.1 |
| 5,103,888 | A | | 4/1992 | Nakamura | 160/171 |
| 5,105,867 | A | | 4/1992 | Coslett | 160/84.1 |
| 5,133,399 | A | | 7/1992 | Hiller et al. | 160/171 |
| 5,141,041 | A | | 8/1992 | Katz et al. | 160/84.1 |
| 5,157,808 | A | | 10/1992 | Sterner, Jr. | 16/197 |
| 5,170,108 | A | * | 12/1992 | Peterson et al. | 318/469 |
| 5,170,830 | A | | 12/1992 | Coslett | 160/84.1 |
| 5,178,200 | A | * | 1/1993 | Hagen | 160/107 |
| 5,184,660 | A | | 2/1993 | Jelic | 160/171 |
| 5,228,491 | A | | 7/1993 | Rude et al. | 160/171 |
| 5,274,357 | A | | 12/1993 | Riordan | 340/550 |
| 5,313,998 | A | | 5/1994 | Colson et al. | 160/84.1 D |
| 5,318,090 | A | | 6/1994 | Chen | 160/171 |
| 5,320,154 | A | | 6/1994 | Colson et al. | 160/121.1 |
| 5,363,898 | A | | 11/1994 | Sprague | 160/98 |
| 5,391,967 | A | | 2/1995 | Domel et al. | 318/254 |
| 5,413,161 | A | | 5/1995 | Corazzini | 160/7 |
| 5,467,808 | A | | 11/1995 | Bell | 160/168.1 |
| 5,482,100 | A | | 1/1996 | Kuhar | 160/170 |
| 5,482,105 | A | * | 1/1996 | Rude | 160/307 |
| 5,485,875 | A | | 1/1996 | Genova | 160/168.1 |
| 5,524,692 | A | | 6/1996 | John | 160/168.1 |
| 5,531,257 | A | | 7/1996 | Kuhar | 160/168.1 |
| 5,547,009 | A | | 8/1996 | Plumer | 160/310 |
| 5,706,876 | A | | 1/1998 | Lysyj | 160/84.05 |
| 5,855,235 | A | | 1/1999 | Colson et al. | 160/121.1 |
| 6,003,584 | A | | 12/1999 | Weinreich | 160/191 |
| 6,009,931 | A | | 1/2000 | Peterson | 160/168.1 R |
| 6,012,506 | A | | 1/2000 | Wang et al. | 160/170 |
| 6,024,154 | A | | 2/2000 | Wang et al. | 160/170 |
| 6,029,734 | A | | 2/2000 | Wang et al. | 160/170 R |
| 6,044,889 | A | * | 4/2000 | Liu | 160/172 R |
| 6,056,036 | A | | 5/2000 | Todd et al. | 160/84.05 |
| 6,079,471 | A | | 6/2000 | Kuhar | 160/170 R |
| 6,095,222 | A | | 8/2000 | Voss | 160/84.05 |
| 6,135,189 | A | | 10/2000 | Weinreich | 160/191 |
| 6,149,094 | A | | 11/2000 | Martin et al. | 242/373 |
| 6,227,279 | B1 | | 5/2001 | Belongia et al. | 160/115 |
| 6,234,236 | B1 | | 5/2001 | Kuhar | 160/170 R |
| 6,283,192 | B1 | * | 9/2001 | Toti | 160/170 R |
| 6,289,964 | B1 | * | 9/2001 | Colson et al. | 160/121.1 |
| 6,330,899 | B1 | * | 12/2001 | Ciuca et al. | 160/170 R |
| 2002/0011315 | A1 | * | 1/2002 | Ciuca et al. | 160/170 R |
| 2002/0033240 | A1 | * | 3/2002 | Toti | 160/170 R |

OTHER PUBLICATIONS

OTHER PUBLICATIONS

U.S. patent application 09/450,109 filed on Nov. 29, 1999 and listing Zazu Ciuca, Patrick Woods, Roger Palmer, Brian Ruggels, and Otto Kuhar as inventors (77056/292A) (31 pages).

U.S. patent application 09/918,905 filed on Nov. 1, 2001 and listing Zazu Ciuca as inventor (77056/348) (29 pages).

U.S. patent application 09/724,279 filed on Nov. 28, 2000 and listing Michael D. Hillman, Evan T. Ward, And Paul B. Specht (77056/318) (61 pages).

U.S. patent application 09/229,111 filed on Jan. 12, 1999 and listing Rober J. Voss, Kelly L. Murphy, and Otto Kuhar as inventors (77056/287) (20 pages).

International Search Report, International Application No. PCT/US02/37670, mailed Mar. 25, 2003.

U.S. patent applicaiton 09/611,328 filed on Jul. 6, 2000 and listing Zazu Ciuca and Roger Palmer as inventors (29498/35731) (30 pages).

* cited by examiner

VARIABLE FRICTION DEVICE FOR A CORDLESS BLIND

This application claims the benefit of provisional application 60/226,847 filed of Aug. 22, 2000.

FIELD OF THE INVENTION

The present invention relates to cordless blinds. More particularly, the present invention relates to a variable friction device for a cordless blind.

BACKGROUND OF THE INVENTION

It is generally known to provide for a window covering venetian blind with the slats that are raised and lowered by a pair of lift cords. Such known window coverings typically include lift cords that are secured to a bottom rail and extend upward through the slats into a head rail. The lift cords are guided within the head rail and exit through a cord lock and hang outside of the window covering. In order to raise or lower the window covering, the lift cords are manipulated to first release the cord lock. Similarly, once the window covering has been raised or lowered the cord lock is manipulated again to lock the cords in place. However, such an arrangement may present a safety concern to small children and pets.

Blinds and shades in which the lift cords are contained within the bottom rail, window covering and head rail are referred to as "cordless" blinds and shades because no portion of the lift cords is external to the blind or shade. Cordless blinds have been gaining popularity and are employed in a wide variety of blinds and shades such as venetian blinds, cellular blinds, pleated shades, and wood blinds. One type of cordless blind disclosed in U.S. Pat. Nos. 5,482,100; 5,531,257; and 6,079,471, and incorporated herein, utilizes a spring motor to apply a spring force to the lift cords to bias the bottom rail and accumulated window covering toward the top rail.

In a "balanced" cordless blind system, the spring force of the spring motor is balanced by the combined weight of the bottom rail (and any accumulated window covering) and friction, sometimes misidentified in the field as inertia. If the system is not in balance, the bottom bar will either move upward or downward depending on the imbalance in the system. For example if the spring force is greater than the weight of the bottom bar (and accumulated window covering) and the frictional forces in the system, then the bottom bar will continue to be biased upward toward the head rail, until the weight of the accumulated window covering balances the system. Similarly, if the spring force and frictional system forces are less than the weight of the bottom bar and accumulated window covering the bottom bar will move downward away from the head rail.

In such balanced cordless blind systems the frictional force is greater than the difference between the spring force and the combined weight of the bottom rail and accumulated window covering when the bottom rail is at any location between a fully raised position (open) and a fully lowered position (closed).

Because the weight of the accumulated window covering increases as the bottom bar moves toward the head rail, the minimum weight occurs when the bottom rail is fully lowered (closed). The friction that is inherent or that is added (e.g., designed into or introduced) to the system needs to be at least sufficient to offset this minimum weight condition, and prevent undesired movement toward the head rail. To prevent the bottom rail from undesirable upward movement, the total friction of the system must be sufficient to resist forces generated by oversized spring motors (which are included to accommodate a variety of sizes of window coverings). Accordingly, because most of the operation of the blind is where the blind is between the fully raised and fully lowered positions, the system has more friction than is necessary to balance it. However, operator force necessary to overcome excess friction may damage the window covering, the head rail, the spring motor, or the mounting brackets, and the like. Also, while a blind with a superfluous amount of friction will operate (so long as there is sufficient spring force to retract the liftcords), it is unduly and unnecessarily laborious for the user.

Accordingly, it would be desirable to provide a cordless blind having a device that would vary the amount of friction introduced into a blind actuation system. It would also be advantageous to provide a cordless blind having a variable friction device, in which the blind could be raised by manual biasing of the bottom rail toward the top rail without releasing a brake. To provide an inexpensive, reliable, and widely adaptable variable friction device for a cordless blind that avoids the above-referenced and other problems would represent a significant advance in the art.

SUMMARY OF THE INVENTION

A primary feature of the present invention is to provide an inexpensive, easy-to-manufacture and aesthetically-pleasing balanced cordless blind that overcomes the above-noted disadvantages.

Another feature of the present invention is to provide a device that provides a varying amount of friction to a cordless blind system.

Another feature of the present invention is to provide a variable friction device design that is adaptable to work with a variety of window covering configurations.

Another feature of the present invention is to provide a variable friction device that can be located in the head rail or the bottom rail.

How these and other advantages and features of the present invention accomplished (individually, collectively, or in various subcombinations) will be described in the following detailed description of the preferred and other exemplary embodiments, taken in conjunction with the FIGURES. Generally, however, they are accomplished in a blind including a head rail, a bottom rail, and a window covering located between the head rail and the bottom rail, and a spool and spring motor assembly. The bottom rail is connected to the head rail by two lift cords and is configured to move in a first direction and in a second direction. The spool and spring motor assembly is configured to bias the bottom rail toward the head rail. The blind also includes a variable friction device that includes a pair of first frictional bearing surfaces configured to provide resistance to movement of the two lift cords, a pair of second frictional bearing surfaces configured to provide resistance to movement of the two lift cords, and a biasing member coupled to one of the first frictional bearing surfaces and the second frictional bearing surfaces. The biasing member is configured to expand and contract based on the direction of movement of the bottom rail. The variable friction device is configured to provide a first friction path for the two lift cords when the bottom rail is moved in the first direction and a second friction path for the two lift cords when the bottom rail is moved in the second direction, the first friction path being different than the second friction path.

These and other advantages and features of the present invention may also be accomplished in a blind including a head rail, a bottom rail, and a window covering located between the head rail and the bottom rail. The bottom rail being connected to the head rail by two lift cords and configured to move in a first direction and a second direction. The blind also includes a variable friction device having a bearing surface configured to provide a first friction force that opposes movement of the two lift cords when the bottom rail is moved in the first direction, and a second friction force that opposes movement of the two lift cords wherein the bottom rail is moved in the second direction. The first friction force is different than the second friction force.

These and other advantages and features of the present invention may also be accomplished in blind including a head rail, a bottom rail, and a window covering located between the head rail and the bottom rail, the bottom rail being connected to the head rail by a pair of lift cords and configured to move in a first direction and a second direction. The blind also includes a first bearing surface and a second bearing surface defined by the contact surface area between the two lift cords and the first and second bearing surfaces, and means for varying the friction force between the first and second bearing surfaces and the left cords.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

DETAILED DESCRIPTION OF PREFERRED AND OTHER EXEMPLARY EMBODIMENTS

Figure 1:
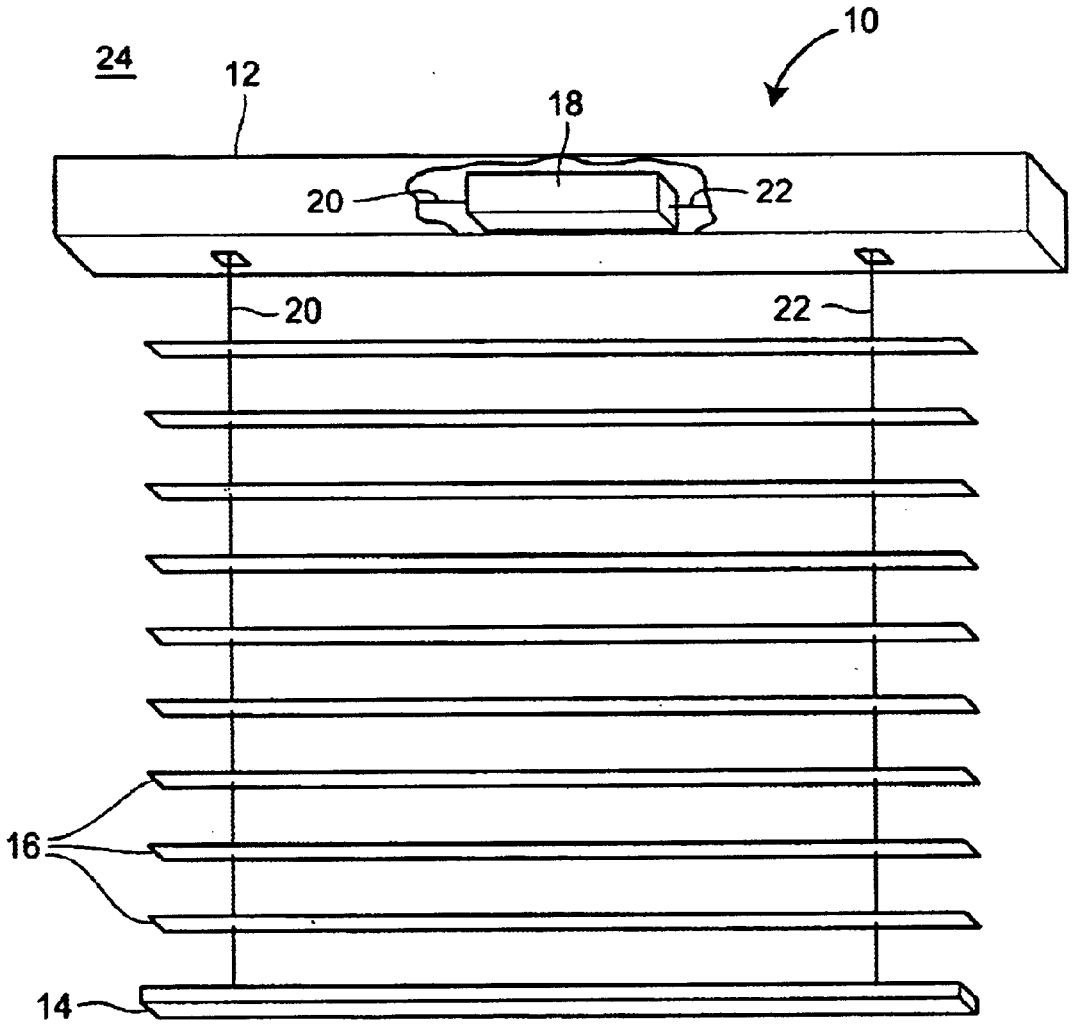
FIG. 1 is a perspective view of a cordless blind according to an exemplary embodiment.

The exemplary embodiments shown in the FIGURES relate generally to the art of window coverings such as venetian blinds and window shades that are "cordless" and "balanced." More specifically, the present exemplary embodiments relate to balanced cordless blinds having a device to attain one or more desired performance characteristics by varying the amount of friction in the system. (The exemplary embodiments may also relate to the art of window coverings that are "cordless" and incorporate a "brake" to secure the bottom rail in position.)

Performance characteristics of a blind may include the effort necessary to raise or lower the bottom rail, the speed of which the bottom rail may be raised or lowered, and whether the bottom rail remains in a static position relative to the head rail when released (i.e., "balanced"). The performance characteristics of the blinds and drive actuators shown in the FIGURES may depend on the customers preferences, and may be variable, selectable, and adjustable by a retail sales associate, the installer, and/or the customer. According to a preferred embodiment, the amount of friction in the system is low when the blind is being raised or lowered so that the amount of effort exerted by (or the amount of resistance felt by) the user is minimal. When the blind is not being raised or lowered, the amount of friction in the system is high so that the blind remains in a static position (i.e., does not free-fall from the weight of the bottom rail or does not raise from a strong spring motor). Providing different amounts of friction at different times during operation of the blind is accomplished by varying the friction path of the lift cords as described herein (e.g., by varying the normal force applied to the lift cords, varying the amount of surface area in contact with the lift cords, varying the tension in the lift cords, varying the (physical) directional or angular path of the lift cords so that they move against varying bearing surfaces). Any of these methods can be modified or combined to attain a variable friction path.

As shown in the FIGURES, the blind is configured to be balanced at any of a variety of times (e.g., after a test operation at a retail sales location, after customization which may be done at the point of sale or prior to installation or the like after installation, periodically during its life, etc.). A balanced blind is one that maintains the position of the bottom rail at any position or location between a fully lowered or extended position (wherein the window is covered) and a fully raised position (where the window is uncovered) relative to the head rail when released by the operator.

The performance characteristics, particularly whether a blind is "balanced," depends on a number of variables including weight of the bottom rail plus any accumulated window covering (collectively referred to as "ΣW"), force of the spring motor ("Fs"), and frictional force. A blind is balanced when the friction force is greater than the absolute value of the difference of the weight and the spring motor force (i.e., $f > |\Sigma W - Fs|$).

FIG. 1 shows a blind 10 according to an exemplary embodiment. Blind 10 includes a head rail 12, a bottom rail 14, a window covering (shown as a plurality of slats 16 suspended between head rail 12 and bottom rail 14), and a spring motor 18. Head rail 12 is coupled to bottom rail 14 by a first and second cord 20, 22. Head rail 12 is mounted to a wall 24 by one or more brackets. According to an exemplary embodiment, spring motor 18 is located in head rail 12. Alternatively, spring motor 18 is mounted in bottom rail 14.

When bottom rail 14 is in a lowered position, slats 16 are independently supported from head rail 12 by a flexible ladder and are evenly vertically spaced from one another.

Bottom rail 14 is connected to terminal ends of the ladder. As bottom rail 14 is raised, slats 16 stack upon one another and are supported by bottom rail 14. Bottom rail 14 and any stacked slats 16 are supported by first and second cords 20, 22 on each end of the bottom rail. First and second cords 20, 22 on each end are located proximate the longitudinal edges of the slats. Depending on the type of slats and size of the blind, other cord configurations may also be employed. As illustrated in FIG. 1 first and second cords 20, 22 of each end of the blind 10 are coupled to the spring motor 18 via one or more respective cord spools. Each cord spool is coupled to the spring motor such that rotation of the cord spool results in rotation of the spring motor.

To ensure that the bottom rail does not move downward without additional force, the combined weight of the bottom rail (BRw) and the accumulated window covering (WCw) must be less than the forces resisting downward movement including the system friction (Ffd) resisting downward movement and the spring force of the spring motor (SMf). This can be expressed as (BRw+WCw)<(SMf+Ffd). The system friction (Ft) tends to oppose movement in both directions, although not necessarily with the same force, depending on the source of the system friction. Accordingly, system friction that opposes downward movement of the bottom rail will be designated Ffd and system friction that opposes upward movement of the bottom rail will be designated Ffu. For example, movement of the bottom rail in a downward direction away from the head rail simply requires the operator to exert a downward force sufficient to overcome any system frictional forces (Ffd) resisting downward movement and the difference between the spring motor force (SMt) and the weight of the bottom rail (BRw) and the weight of the accumulated window covering (WCw). The force required by the operator (Oft to move the bottom rail downward can be expressed as Of>(SMf+Ffd)−(BRw+WCw).

For the bottom rail to be urged upward, the spring force is greater than the forces resisting upward movement of the bottom rail: SMf>Ffu+(BRw+WCw).

Friction is provided to the lift cords by the variable friction device. The variable friction device is configured to provide a resistant force on movement of one of the first and second cords 20, 22 depending any a variety of factors, including whether bottom rail is in a static position or being raised or lowered, the direction of the user's movement of bottom rail 14, speed of said movement, location of bottom rail 14 relative to head rail 12, and the like.

The friction force applied to cords 20, 22 by the variable friction device acts to balance the forces within blind 10 and prevent undesired movement of bottom rail 14 ("creep"). Although the frictional force can be modified by varying the combination of cord material and pulley composition the friction force would remain static.

As shown in the FIGURES, variable friction device 28 applies a varying friction force (Vf) to the lift cords. The particular friction force applied by the variable friction device to the lift cords is intended to be greater than the spring force of the spring motor (SMf) minus the combined weight of the bottom rail (BRw) and the weight of accumulated window covering (WCw) and the system friction (Ffu) opposing upward motion of the bottom rail. This can be expressed as Vf>SMf−(Ffu+BRw+WCw).

According to a preferred embodiment, the varying frictional force (Vf) applied by the variable friction device is sufficient to prohibit the bottom rail from moving downward and away from head rail 12 without additional force, and yet is sufficient to prohibit the lift cords from rewinding thereby causing the bottom rail to move upward. The frictional force (Vf) introduced by the variable friction device is configured to be sufficient to prevent the blind from moving downward: Vf>(BRw+WCw)−(SMf+Ffd).

When a user manually raises the bottom rail, the spring force of spring motor 18 is sufficient to wind the lift cords about the cord spools. The force required by the user (Of) to raise the bottom rail such that the spring motor force will wind the lift cords must be greater than the difference between the spring motor force (SMf) and the combined weights of the bottom rail (BRw) and accumulated window covering (WCw) and the system friction (Ff) opposing upward movement of the bottom rail: Of>[(SMf)−(BRw+WCw+Ffu)].

To optimize the operation of the variable friction device, blind 10 is balanced such that the equations outlined above for the various systems will be appropriate. The factors that can be varied (once the window covering size is set) include the spring motor force, the variable friction device (see FIGS. 19 and 20), and the weight of bottom rail 14 (e.g., by adding additional weight to or removing weight from bottom rail 14). The spring force can be varied by utilizing a spring motor having a greater or lesser spring force as required, or by adding or removing spring motor modules to achieve the required spring force.

According to a preferred embodiment, the system frictional forces are varied as bottom rail 14 is moved from a fully lowered (closed) position (in which the bottom rail is furthest from the head rail) to a fully raised (open) position (in which the bottom rail is closest to the head rail) because the weight of the window covering that accumulates on bottom rail 14 increases (as the bottom rail moves toward the head rail). The system friction is varied to assist the user in moving the bottom rail (e.g., lessen the resistance to movement).

Friction forces applied to the lift cords are a function of surface area contact between the lift cords and the bearing surfaces, and a function of the normal (or perpendicular) force applied to the lift cords by biasing members (e.g., tension in springs) at the point of contact between the lift cords and the bearing surfaces. For example, as shown in the FIGURES, when the biasing members are expanded or stretched (e.g., when the bottom rail is at rest or is being lowered), the biasing members have an increased tension thereby applying an increased normal force on the lift cords which causes more friction that resists movement of the lift cords. When the biasing members are allowed to contract (e.g., when the bottom rail is being lifted), there is less tension in biasing members thereby a reduced normal force being applied to the lift cords, which causes less friction that resists movement of the lift.

As such, variable friction device 28 is configured to provide an increased amount of friction when bottom rail 14 is in a static position. This increased resulting friction is intended to prevent upward or downward movement of bottom rail 14 (commonly referred to as "creep"). However, as bottom rail 14 is manually lifted by a user to raise bottom rail 14 toward head rail 12, the friction force applied to the lift cords is decreased allowing the lift cords to slide around bearing surfaces 30. Variable friction device 28 is intended to apply friction to the cords in the direction needed to prevent creep.

Figure 2:
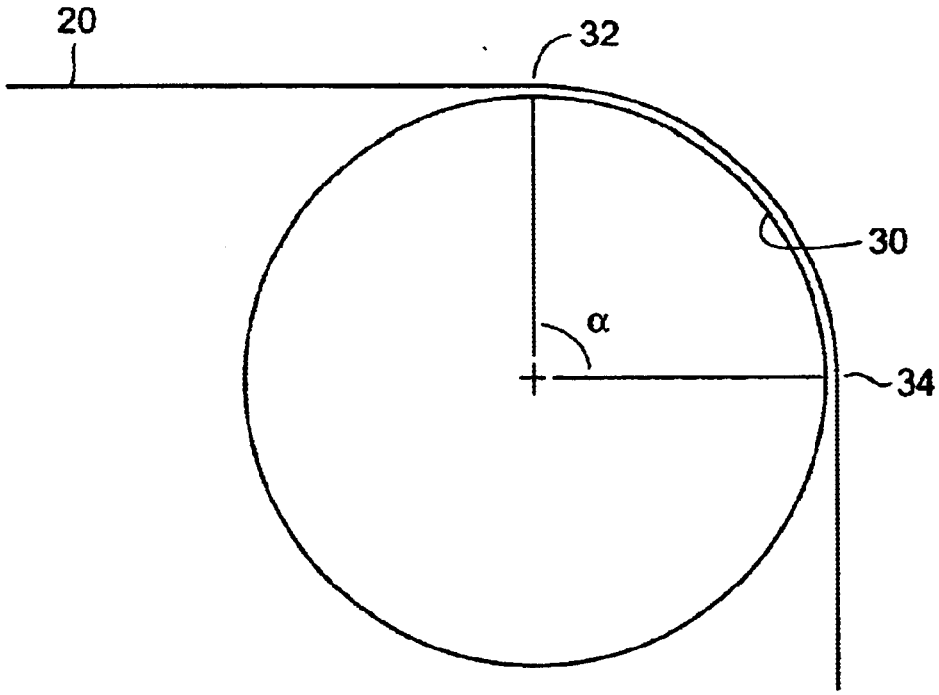
FIG. 2 is a schematic view of a bearing surface for a variable friction device according to an exemplary embodiment.
Figure 3:
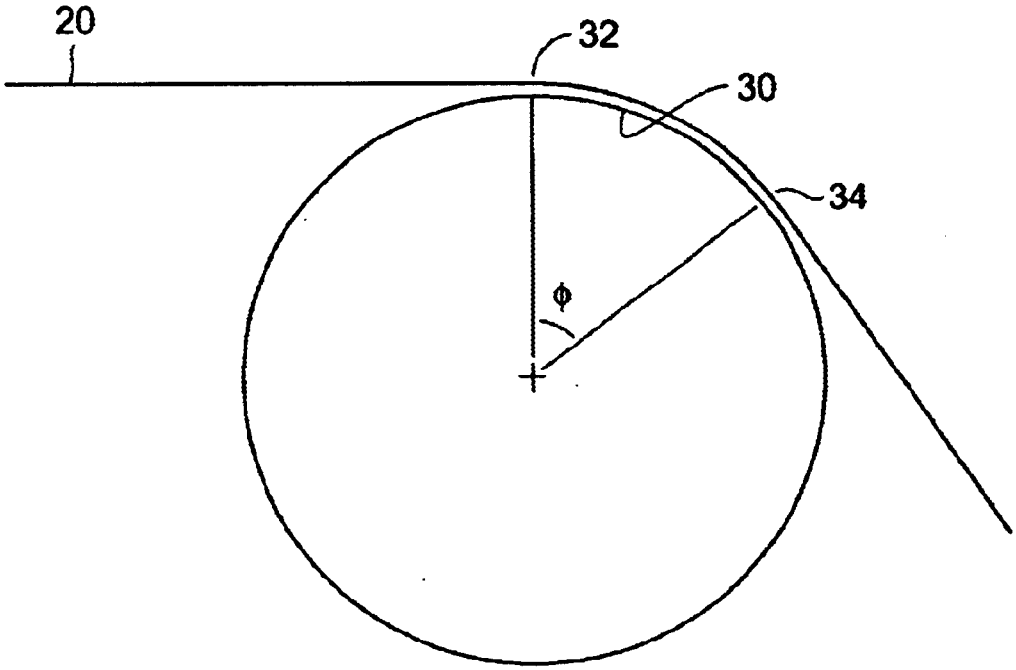
FIG. 3 is a schematic view of the bearing surface of FIG. 2 with a smaller friction path.

Referring to FIGS. 2 and 3, the amount of friction provided to cords 20 (and/or 22) is also proportional to the amount of surface area in contact between cords 20 (and/or 22) and a bearing surface 30 (i.e., the "friction path"). Bearing surface 30 may be provided by any of a variety of components, including an eyelet one-way or two-way pulleys, a bearing, a radiused edge, and the like. According to a preferred embodiment, the variable friction device includes a plurality of bearing surfaces 30 provided on one or more components located throughout blind 10 that are configured to co-act to vary friction and therefore resistance or performance sensed by the user.

According to an exemplary embodiment, the friction path is dependent on the relative angle $\alpha$ or $\Phi$ between a first portion 32 of cord 20 or 22 and a second portion 34 of cord 20 or 22. During raising and lowering of blind 10, the friction path varies because $\alpha$ and $\Phi$ vary or are altered by one or more bearing surfaces are repositioned to attain a variety of factors or desired performance characteristics. According to a preferred embodiment, the friction path is configured to decrease as bottom rail 14 is lowered so that the friction force introduced to the system decreases, thereby requiring less effort to lower bottom rail 14 to decrease the amount of friction when bottom rail 14 is lowered. Comparing FIG. 2 with FIG. 3, the friction path (which is directly related to the friction imparted to the system) is greater because $\alpha$ is larger than $\Phi$, which provides for a greater contact surface area.

Figure 4:
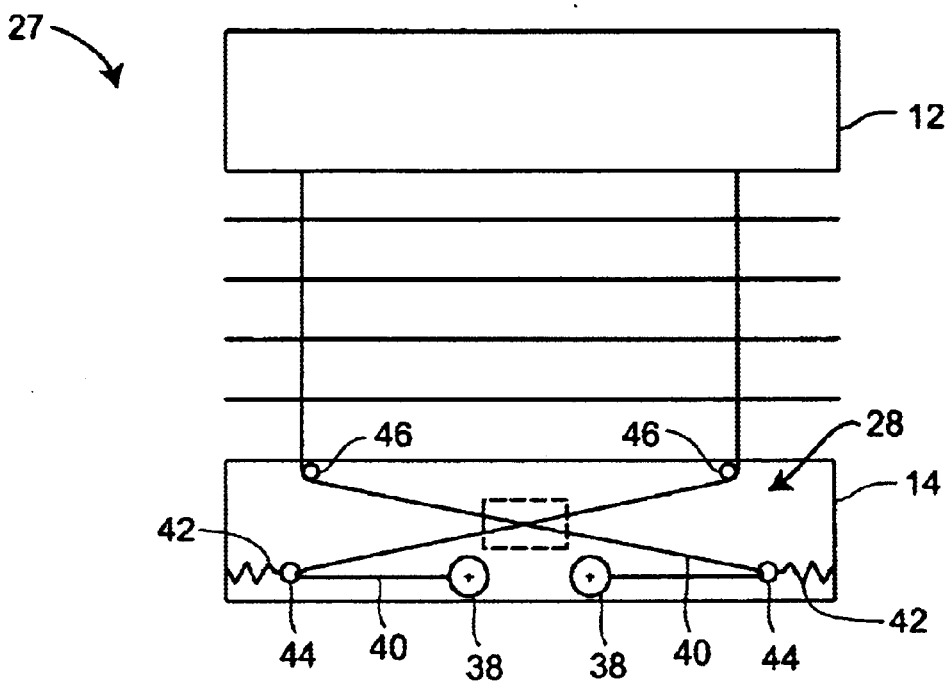
FIGS. 4 and 5 are schematic views of a blind with a variable friction device according to an exemplary embodiment.
Figure 5:
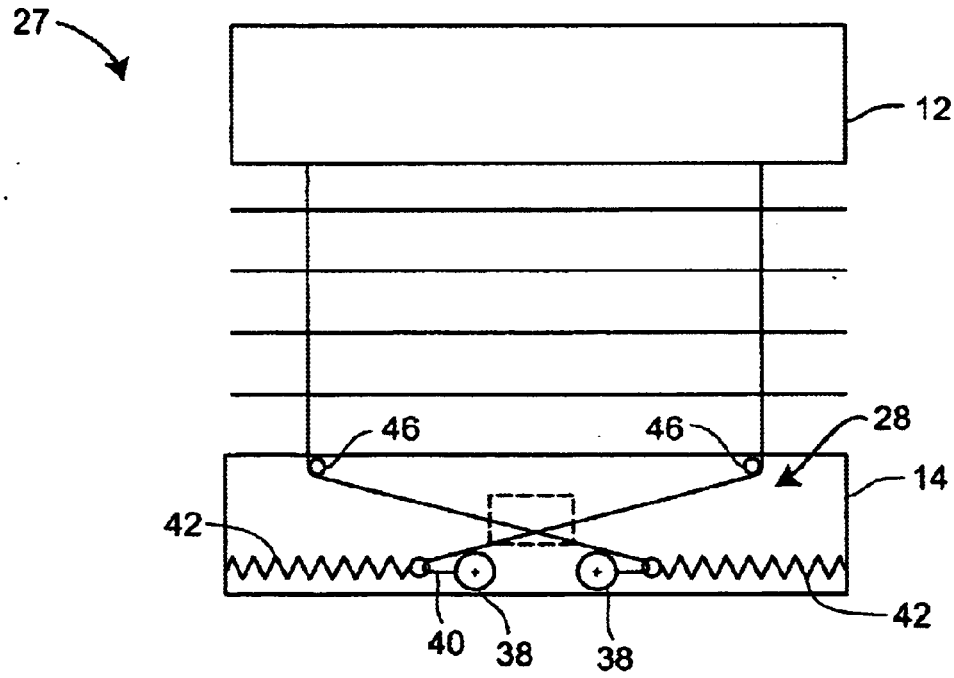
Figure 6:
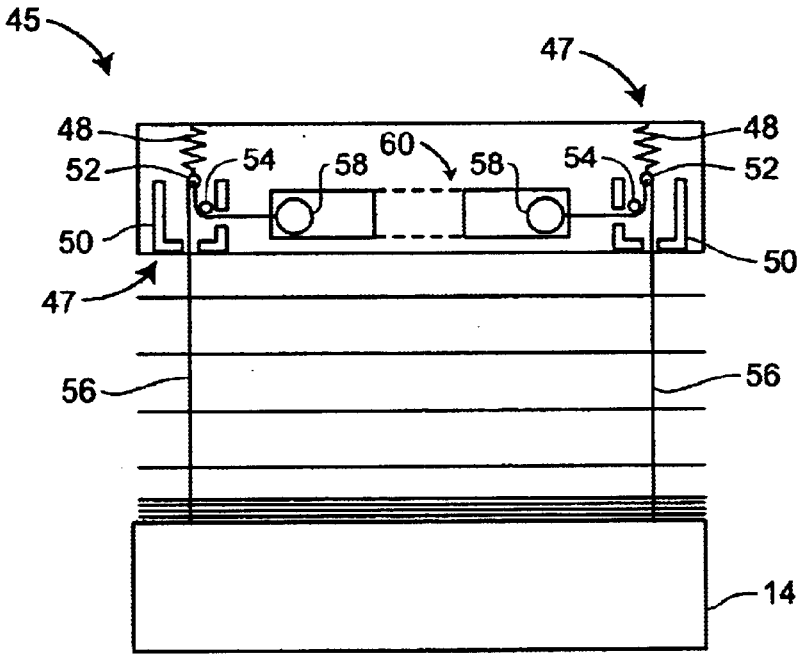
FIGS. 6–10 are schematic views of a blind with a variable friction device according to an exemplary embodiment.

Referring to FIGS. 4 and 5, a blind 27 includes a variable friction device 28 is located in bottom rail 14, along with a pair of cord storage spools 38. Each spool 38 include a spring biased to wind cords 40 about spools 38, which can be provided by friction introduced to the system and/or by a brake (e.g., a one-way or two-way brake shown in broken lines). Variable friction device 28 includes a pair of biasing members (shown as tension springs 42) that are coupled to bottom rail 14 and to cords 40. According to a preferred embodiment, eyelets 44 are attached at ends of springs 42 and are configured to provide bearing surface 30. Alternatively, a one-way or two-way pulley is mounted to end of springs 42. According to an exemplary embodiment, a secondary bearing surface 46 is provided in bottom rail 14, and shown as a radiused edge where cords 40 exit bottom rail 14. (Also, variable friction device 28 may be located in head rail 12.)

As bottom rail 14 is lowered, tension is applied to springs 42 by cords 40. Springs 42 expand or lengthen, thereby providing an increasing amount of friction as the normal force applied to cords 40 increases, which is offset, at least in part, by the contact surface area.

When the bottom rail 14 is at rest, springs 42 are expanded (in tension) due to the weight of the bottom rail and accumulated slats. Tension in spring 42 apply a friction force sufficient to maintain bottom rail 14 in a static position (overcoming the spring force of spring motor 38).

When the bottom rail is raised, springs 42 fully contract and provide minimal, if any, friction force to cords 40. Slackness in cords 40 is taken up (or wound up) by the strength of spring motor 38. According to a preferred embodiment, the strength of the spring motor is merely sufficient to wind up slack cords 40 (which provides for an inexpensive spring motor design and material costs).

According to an alternative embodiment shown in FIGS. 6–10, a blind 45 includes a variable friction device 47 having a biasing member (shown as a spring 48) is suspended from a top portion of head rail 12 and at least partially disposed in a cradle 50. Variable friction device 47 includes a first bearing surface 52 and a second bearing surface 54. The friction path is provided by a cord 56 passing over or across first bearing surface 52 and second bearing surface 54. One end of cord 56 is coupled to bottom rail 14, and the other end of cord 56 is wound about a spool 58, which is operatively coupled to a spring motor 60. First bearing surface 52 is provided with spring 48 and second bearing surface 54 is provided with cradle 50 (e.g., an eyelet or a pulley mounted in cradle 50, a radiused edge or other protrusion where cord 56 exits cradle 50 to engage spring motor 60.

Figure 7:
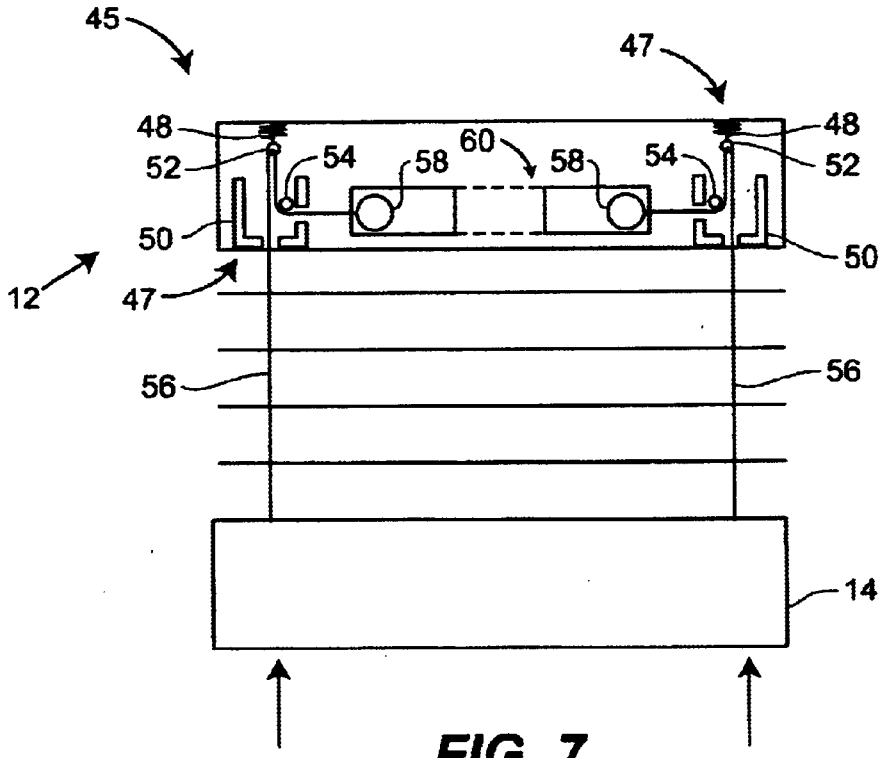

Referring to FIG. 7, as bottom rail 14 is moved upward, variable friction device 47 provides a relatively small amount of friction (due to the lack in tension in cord 56), which is overcome by spring motor 60 as it winds slack cord 56 about spool 58. Preferably, the strength of spring motor 60 is configured such that this increased friction condition is not sensed by the operator (e.g., delays or apparent slowness when winding cord 56 on spool 58, observable slack in cord 56, etc.).

Figure 8:
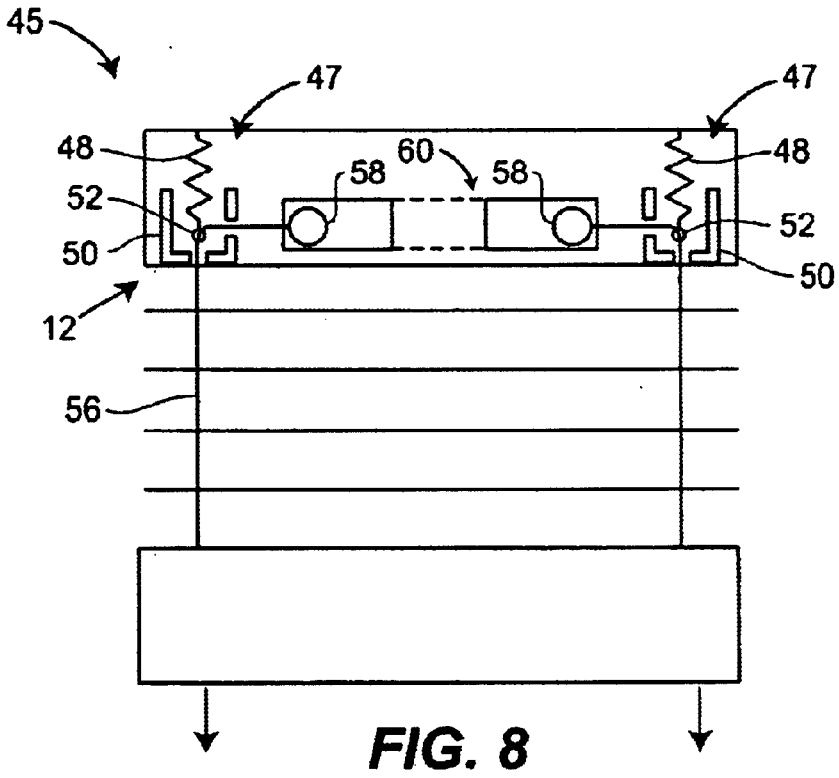

Referring to FIG. 8, as bottom rail 14 is lowered or pulled downward (toward the closed or extended portion) by the user, tension is transferred by cord 56 to spring 48, thereby causing spring 48 to expand or lengthen. Lengthening of spring 48 increases tension in spring 48 and increases the friction applied by first and second bearing surfaces 52, 54. The friction is at least partially offset when first bearing surface 52 is substantially aligned with second bearing surface 54. According to a preferred embodiment, such an alignment provides a friction path for a relatively low amount of overall friction.

Figure 9:
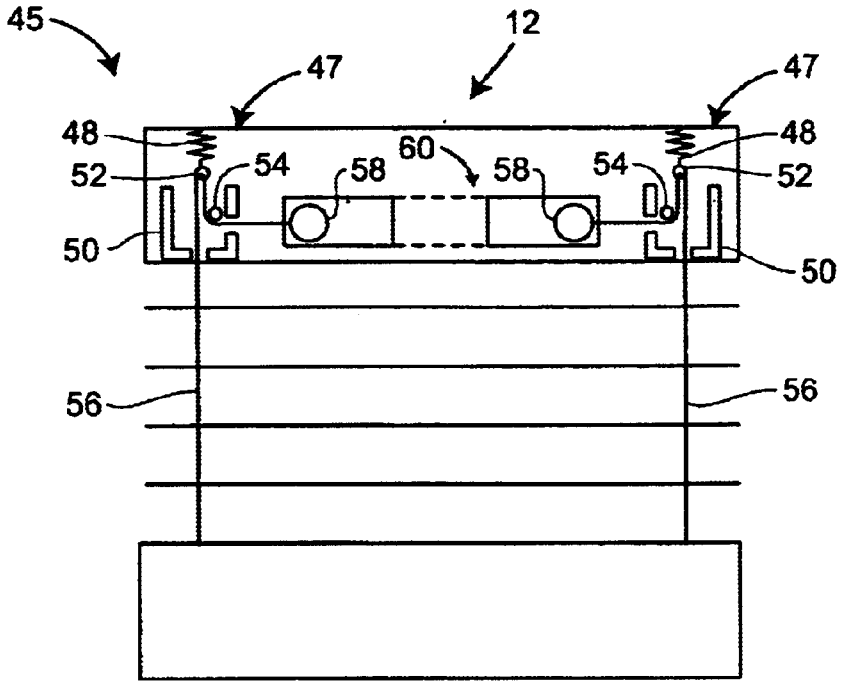
Figure 10:
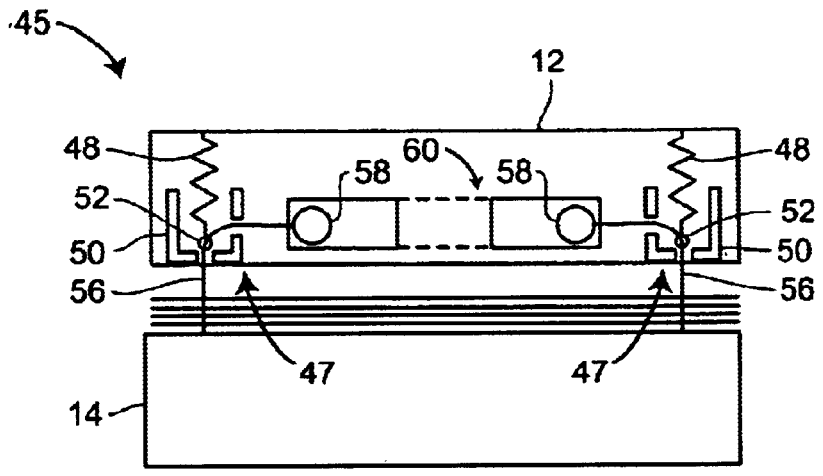
Figure 11:
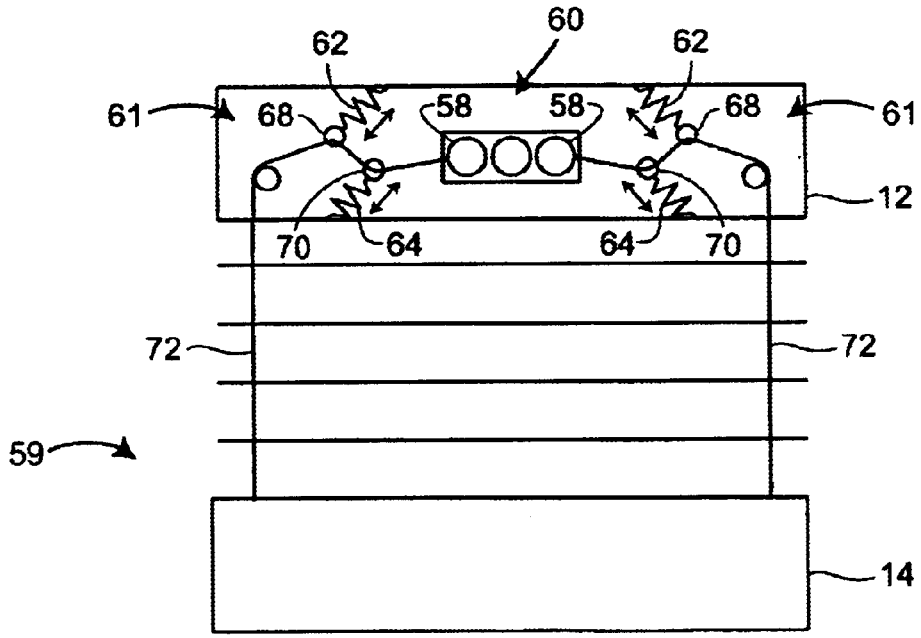
FIGS. 11–14 are schematic views of a blind with a variable friction device according to an exemplary embodiment.

Referring to FIG. 9, when the static position of bottom rail 14 approaches the fully closed or extended position, variable friction device 47 provides a relatively high amount of friction because the weight supported by cords 56 (i.e., the weight of bottom rail 14 plus the weight of few, if any, accumulated slats 16) stretches spring 48, causing increased normal force friction and contact area friction. Referring to FIG. 10, when the static position of bottom rail 14 approaches the fully open position, variable friction device 47 provides sufficient friction to prevent bottom rail 14 from lowering, which is based on the weight supported on cords 56 is maximized (i.e., the weight of bottom rail 14 plus the weight of the accumulated slats 16) thereby maximizing the tension in spring 48. (The contact area friction in FIG. 10 is less than the contact area in FIG. 9).

According to an alternative embodiment shown in FIGS. 11–14, a blind 59 includes spring motor 60 is mounted in head rail 12 or bottom rail 14 along with a variable friction device 61 having a pair of biasing members (shown as springs 62, 64. Variable friction device 61 includes a first bearing surface 68 and a second bearing surface 70. The friction path is provided by a cord 72 passing over or across first and second bearing surfaces 68, 70. One end of cord 72 is coupled to bottom rail 14, and the other end of cord 72 is wound about spool 58, which is operatively coupled to spring motor 60. First bearing surface 68 is provided with first spring 62, and second bearing surface 70 is provided with second spring 64 (e.g., an eyelet or a pulley coupled to one end of the springs 62, 64).

Figure 12:
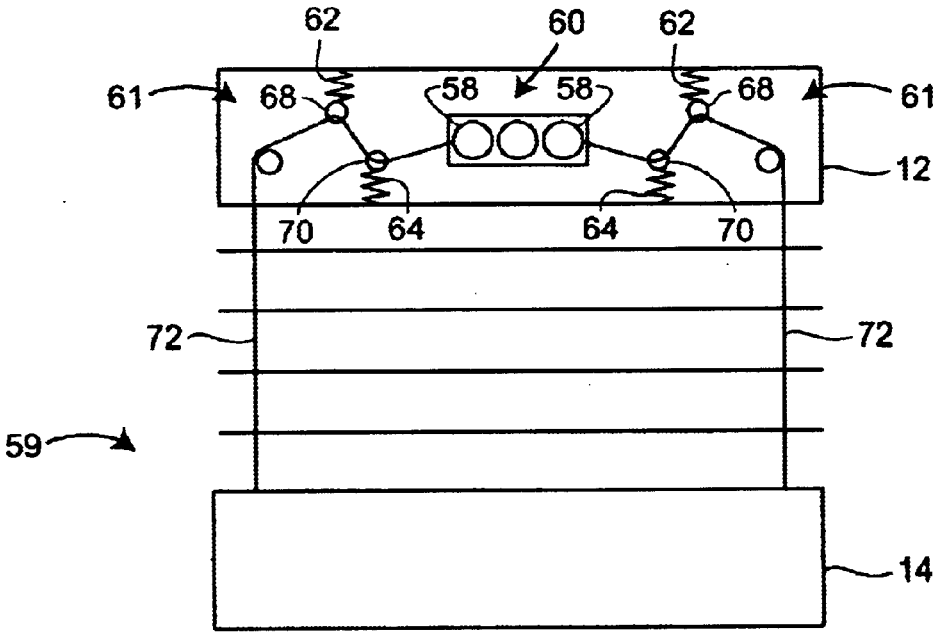
Figure 13:
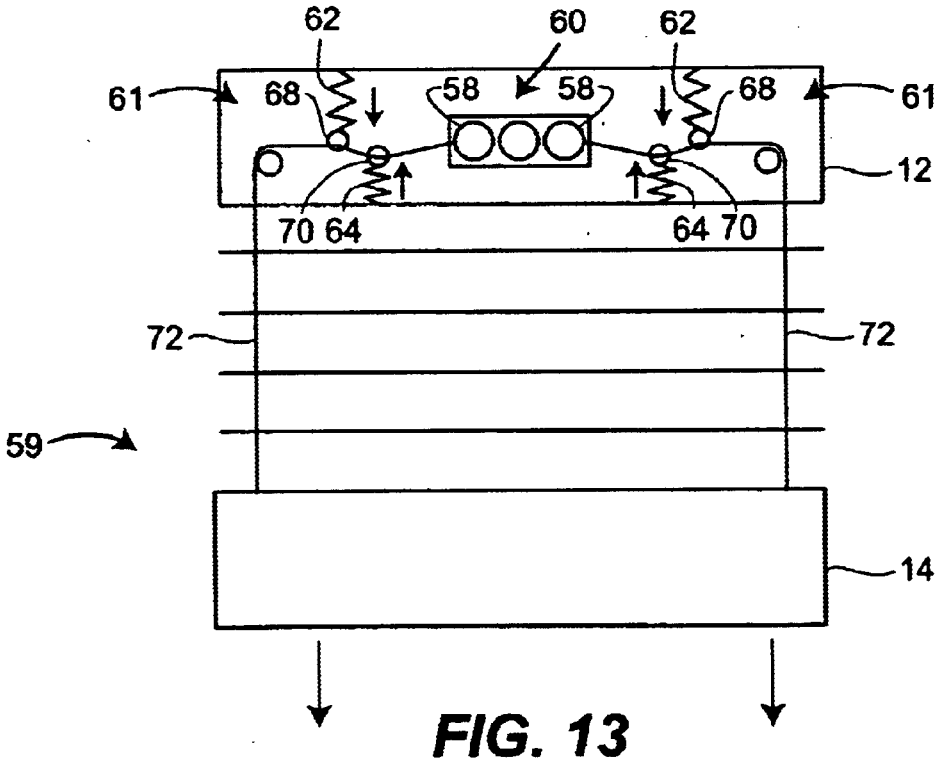

Referring to FIG. 12, variable friction device 61 is shown when blind 10 is in a static or stopped position. Referring to FIG. 13, as bottom rail 14 is lowered or pulled downward (toward the closed or extended position) by the operator, tension is transferred by cord 72 to first and second springs 62, 64, thereby causing springs 62, 64 to expand or lengthen. Lengthening of springs 62, 64 increases the friction applied by first and second bearing surfaces 68, 70, which can be at least partially offset when first bearing surface 68 is substantially aligned to a second bearing surface 70.

Figure 14:
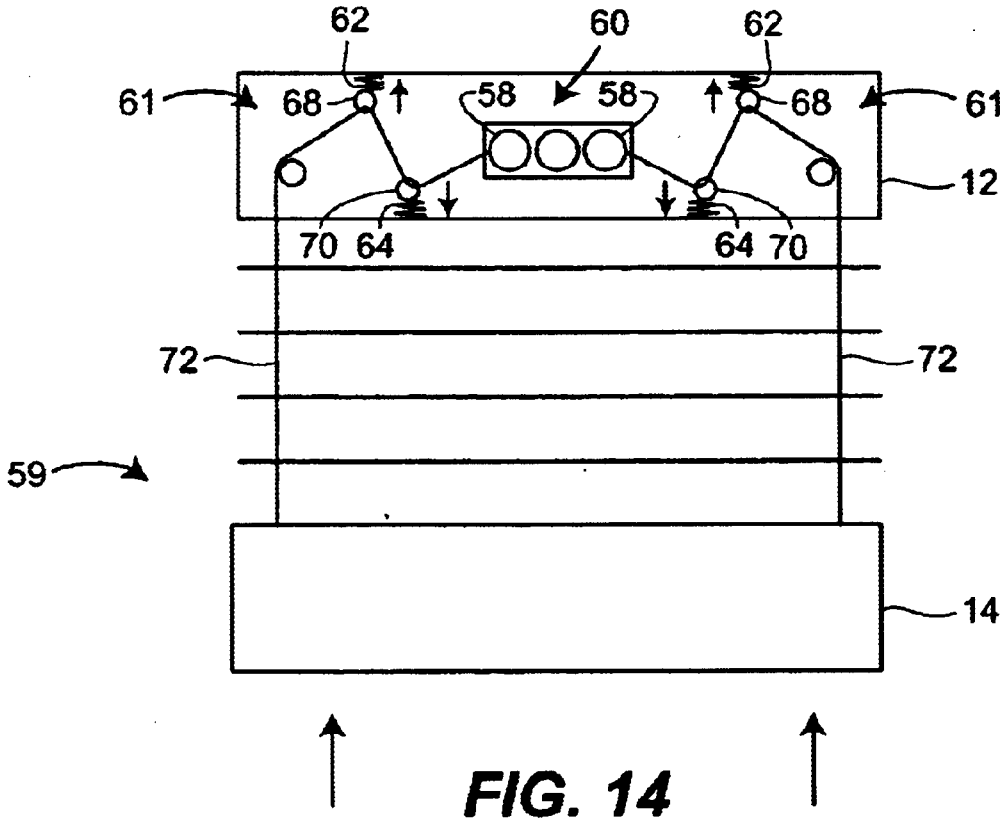

Referring to FIG. 14, as bottom rail 14 is moved upward, the variable friction device 61 provides a relatively low amount of friction due to a reduced tension in springs 62, which is overcome by spring motor 60 as it winds slack cord 72 above the spool 58. Preferably, the strength of spring motor 60 is configured such that this increased friction condition is not sensed by the operator.

According to an alternative embodiment shown in FIGS. 15–18, a blind 73 includes head rail 12, bottom rail 14, a window covering disposed therebetween, and a pair of cords 74 that couple head rail 12 to bottom rail 14. Bottom rail 14 includes one or more spools 58 operatively coupled to a spring motor 60 and a variable friction device 75. Variable friction device 75 includes a biasing member (shown as a tension spring 76), a first bearing surface 78, and a second bearing surface 80, and a third bearing surface 82. The friction provided by a cord passing over or across first bearing surfaces 78, second bearing surfaces 80, and third bearing surface 82. One end of cord 74 is coupled to head rail 12, and the other end of cord 74 is wound about spool 58, which is operatively coupled to spring motor 60.

Figure 15:
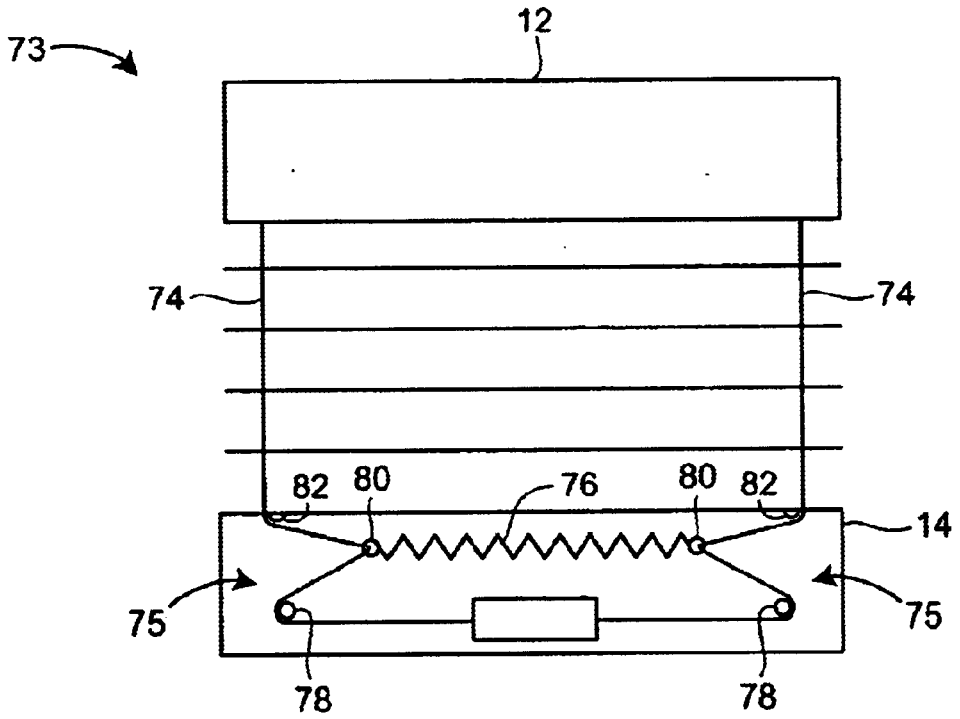
FIGS. 15–18 are schematic views of a blind with a variable friction device according to an exemplary embodiment.
Figure 16:
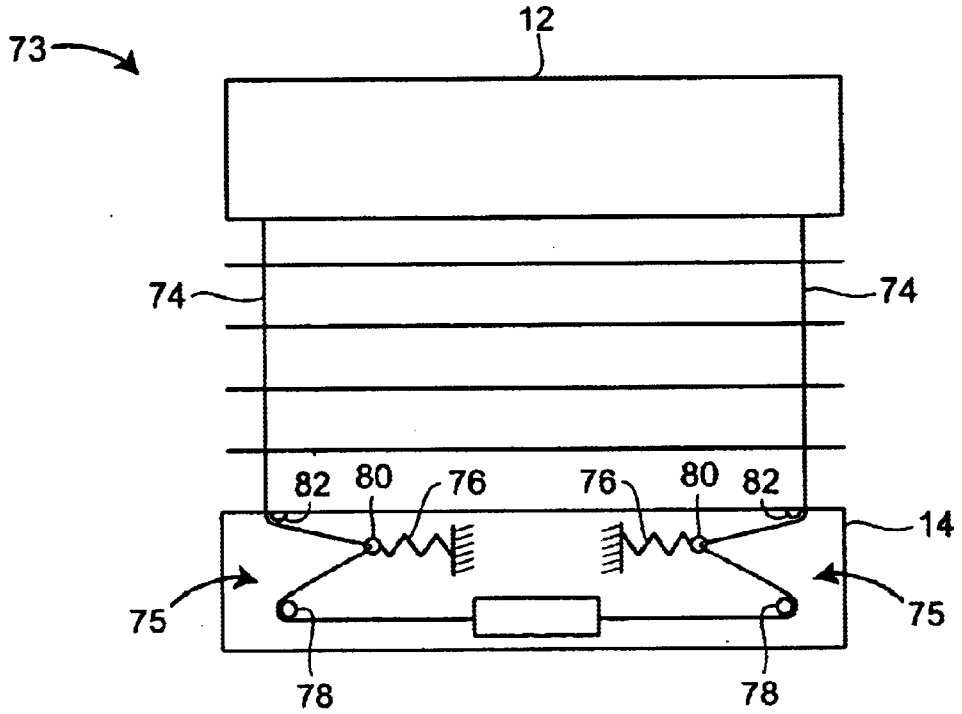
Figure 17:
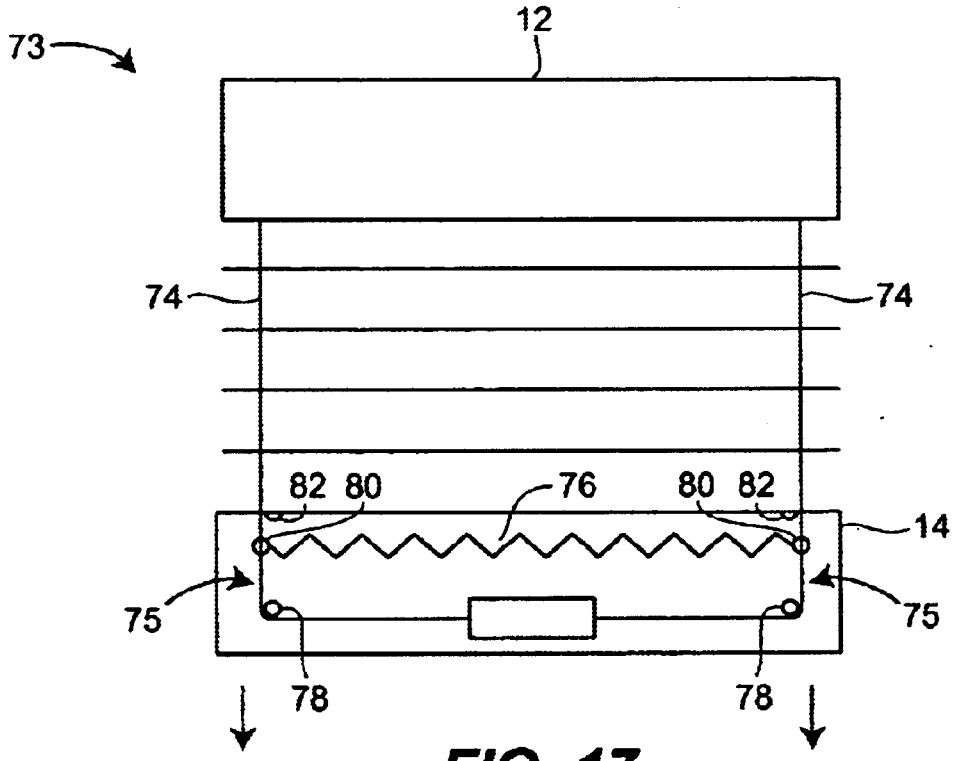

Referring to FIGS. 15 and 16, variable friction device 75 is shown when blind 73 is in a static or stopped position. Referring to FIG. 17, as bottom rail 14 is lowered or pulled downward (toward the closed or extended position) by the operator, tension is transferred by cord 74 to spring 76 thereby causing spring 76 to expand or lengthen. Lengthening of spring 76 increases the friction due to the tension in spring 76. The overall friction is at least partially offset when second bearing surface 80 is substantially aligned to second and third bearing surfaces 78, 82.

Figure 18:
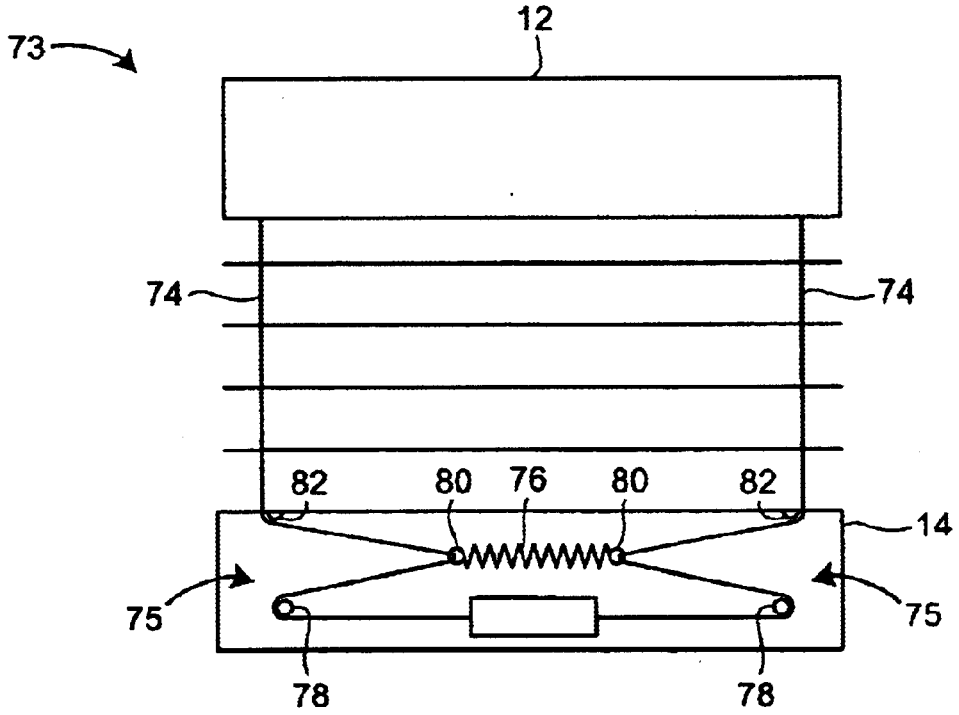

Referring to FIG. 18, as bottom rail is moved upward, variable friction device 75 provides a relatively low amount of friction (due to reduced tension in spring 76), which is overcome by the spring motor as it winds slack cord 74 above the spool. Preferably, the strength of the spring motor is configured such that this increased friction condition is not sensed by the operator.

Figure 19:
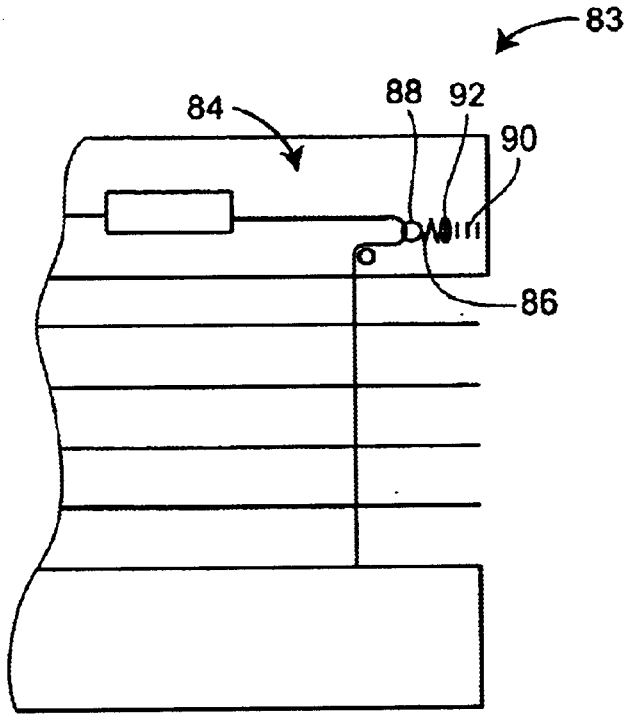
FIG. 19 is a fragmentary schematic view of a blind with a variable friction device according to an exemplary embodiment.
Figure 20:
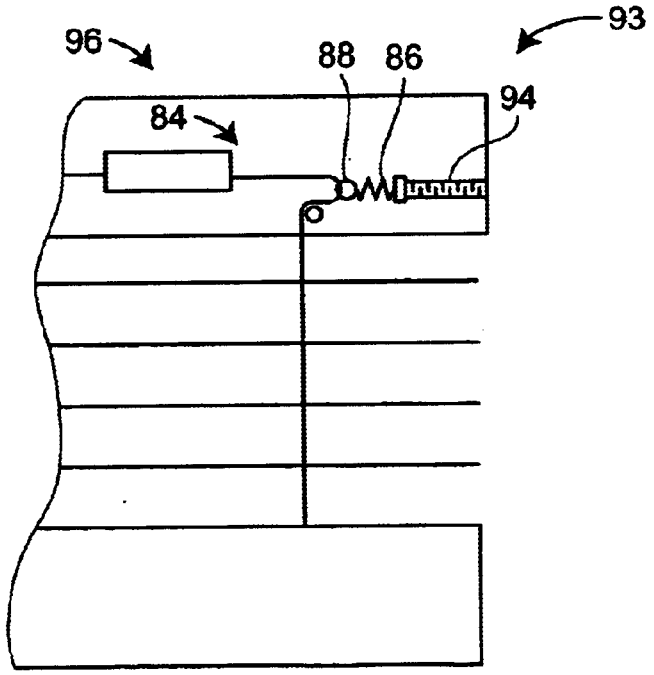
FIG. 20 is a fragmentary schematic view of a blind with a variable friction device according to an exemplary embodiment.

Referring to FIGS. 19 and 20, an adjustable variable friction device configured to provide varying friction during operation of the blind, and to be adaptable or adjustable according to desired performance characteristics, varying sizes of blinds it may be installed in, customized blinds that have their performance characteristics altered when customized in a store (e.g., trimmed or cut to size).

Referring to FIG. 19, a blind 83 including adjustable variable friction device 84 includes a biasing member (shown as a tension spring 86) having a first end with a first bearing surface 88 and a second end that is configured to be fixed to one of several preset or predetermined positions. For example, a plurality of protrusions 90 (e.g., pegs, and the like) are configured to receive a loop 92 at second end of spring 86. Depending on the placement of second end of spring to a particular protrusion 90 the friction path can be adjusted (or changed by moving the second end).

Referring to FIG. 20, a blind 96 including an adjustable variable friction device 93 is shown to have an infinite adjustment capability. For example, the second end of spring 86 is threadably coupled to a rod 94 so that the initial or predetermined friction path is set by the position of the second end of spring 86.

Figure 21:
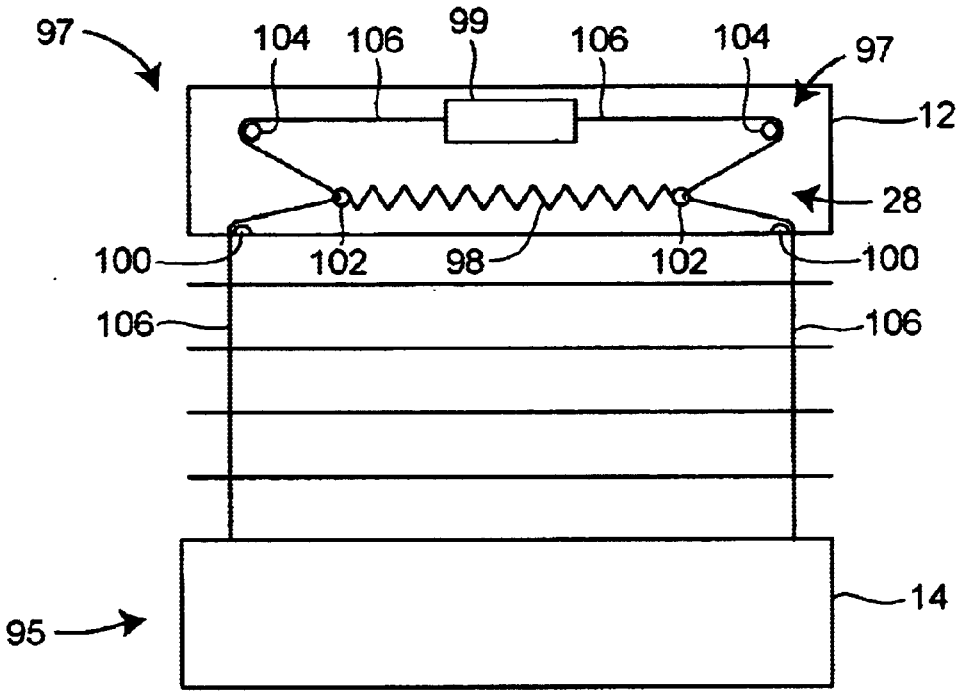
FIG. 21 is a schematic view of a blind with a variable friction device according to an exemplary embodiment.

According to an alternative FIG. 21, a blind 95 includes head rail 12, bottom rail 14, a window covering disposed therebetween, and first and second cords that couple head rail 12 to bottom rail 14. Head rail 12 includes one or more spools operatively coupled to a spring motor 99 and a variable friction device 97. Variable friction device 97 includes a biasing member (shown as a tension spring 98), a first bearing surface 100, a second bearing surface 102, and a third bearing surface 104. The friction passes provided by a cord 106 passing over or across first bearing surfaces 100, second bearing surfaces 102, and third bearing surface 104. One end of cord 106 is coupled to bottom rail 14, and the other end of the cord is wound about a spool, which is operatively coupled to the spring motor in head rail 12.

Figure 22:
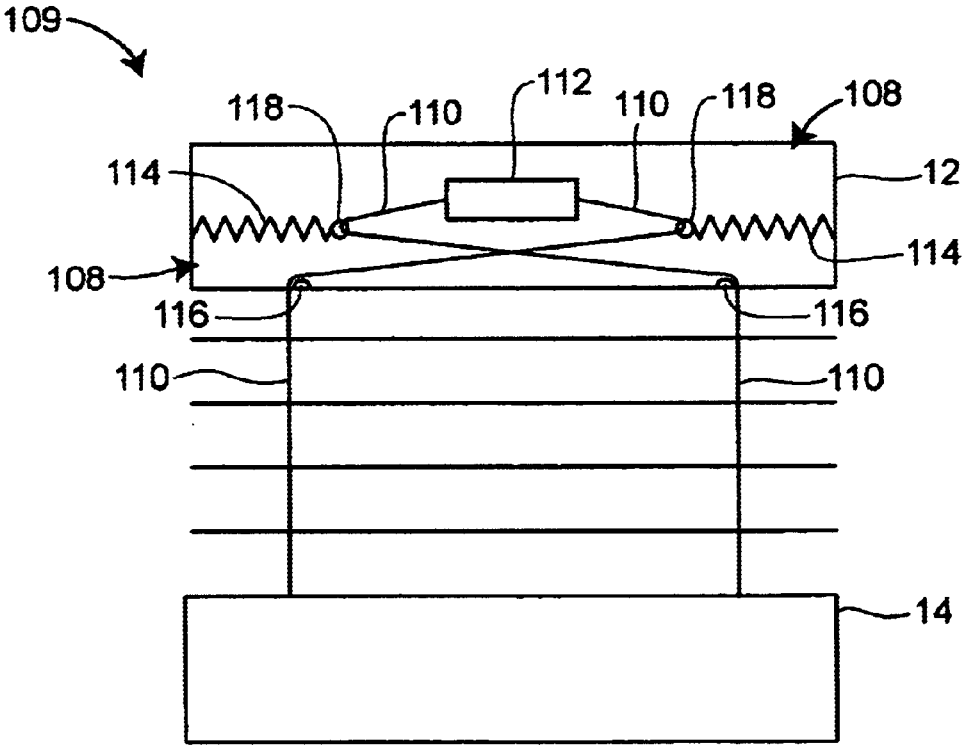
FIG. 22 is a schematic view of a blind with a variable friction device according to an exemplary embodiment.

According to an alternative embodiment shown in FIG. 22, a variable friction device 108 is mounted in head rail 12 of a blind 109. A pair of cords 110 are coupled at one end to bottom rail 14 and at their other end to a constant force motor 112. Biasing members (shown as springs 114) are coupled at one end to head rail 12 and at its other end to cords 110. Variable friction device 108 includes a first bearing surface 116 and a second bearing surface 118. First bearing surface 116 is provided with springs 114 and second bearing surface 118 is provided with head rail 12. Cords 110 cross one another as they extend between first bearing surface 116 and second bearing surface 118. The friction path that is provided by cords 110 passing over or across first bearing surface 116 and a second bearing surface 118.

The term "cordless blind" is not meant as a term of limitation insofar as any window covering (e.g., blind, shade or like apparatus) having a decorative or functional use or application as a window covering or furnishing is intended to be within the scope of the term. The use of the term "cordless blind" is intended as a convenient reference for any blind, shade or structure that does not have cords (example, pull cords) hanging freely for manipulation by the user. It is also important to note that the use of the term "cordless" does not mean that no cords are used within the blind itself. The term "window covering" is intended to include any of the variety of blind arrangements, including horizontal vanes or slats, roller shades, cellular shades, pleated shades, etc.

It is also important to note that the construction and arrangement of the elements of the variable friction device for a cordless blind as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the variable friction device can be located in the head rail or in the bottom rail. Any of a variety of springs can be used (such as conical, spiral, etc.). Also, any the friction or bearing surfaces can be provided as any of a variety of devices, such as stationary surfaces having a known frictional coefficient, one-way pulleys (e.g., to provide varying amounts of friction depending on which direction the pulley is turning), two-way pulleys, eyelets and the like. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A window covering comprising:

a head rail, a bottom rail, and a window covering material located between the head rail and the bottom rail, the bottom rail being connected to the head rail by two lift cords and configured to move in a first direction and in a second direction;

a biasing mechanism configured to bias the bottom rail toward the head rail;

a variable friction device configured to provide a first friction path for the two lift cords when the bottom rail is moved in the first direction and a second friction path for the two lift cords when the bottom rail is moved in the second direction, the first friction path being different than the second friction path, wherein the variable friction device includes a pair of first frictional bearing surfaces configured to provide resistance to movement of the two lift cords, a pair of second frictional bearing surfaces configured to provide resistance to movement of the two lift cords, a biasing member coupled to one of the first frictional bearing surfaces and the second frictional bearing surfaces, and configured to expand and contract based on the direction of movement of the bottom rail.

2. The window covering of claim 1 wherein the first direction is upward toward the head rail, and the second direction is downward away from the head rail.

3. The window covering of claim 2 wherein the length of the first friction path is greater than the length of the second friction path.

4. The window covering of claim 1 wherein movement of the bottom rail upward contracts the biasing member.

5. The window covering of claim 4 wherein the first friction path is configured to provide less resistance to movement of the two lift cords when the rail is moved downward.

6. The window covering of claim 4 wherein movement of the bottom rail downward expands the biasing member.

7. The window covering of claim 1 wherein the biasing member is a spring.

8. The window covering of claim 1 wherein the biasing member includes a first spring and a second spring.

9. The window covering of claim 1 wherein the variable friction device further includes a third frictional bearing surface configured to provide resistance to movement of the two lift cords.

10. The window covering of claim 1 wherein one of the first and second frictional bearing surface is provided by a pulley.

11. The window covering of claim 1 wherein one of the first and second frictional bearing surface is provided by an eyelet.

12. The window covering of claim 1 wherein one of the first and second bearing surface is provided by a radiused aperture.

13. The window covering of claim 1 wherein the variable fiction device is located in the head rail.

14. The window covering of claim 1 wherein the variable friction device is located in the bottom rail.

15. The window covering of claim 1 wherein the window covering material is a plurality of slats.

16. The window covering of claim 1 wherein the variable friction device is further configured to provide a third friction path for the two lift cords when the bottom rail is not being moved.

* * * * *

UNITED STATES PATENT AND TRADEMARK OFFICE

CERTIFICATE OF CORRECTION

PATENT NO. : 6,725,897 B2
DATED : April 27, 2004
INVENTOR(S) : Roger C. Palmer

It is certified that error appears in the above-identified patent and that said Letters Patent is hereby corrected as shown below:

Column 12,
Line 24, please delete "second bearing surface" and insert -- second frictional bearing surface --.
Line 27, please delete "fiction" and insert -- friction --.

Signed and Sealed this

Thirty-first Day of August, 2004

JON W. DUDAS
*Director of the United States Patent and Trademark Office*